US010232633B2

(12) United States Patent
Iwamuro et al.

(10) Patent No.: US 10,232,633 B2
(45) Date of Patent: Mar. 19, 2019

(54) LIQUID ACCOMMODATION BODY AND LIQUID EJECTING APPARATUS

(71) Applicant: SEIKO EPSON CORPORATION, Tokyo (JP)

(72) Inventors: Takeshi Iwamuro, Matsumoto (JP); Hitotoshi Kimura, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/868,820

(22) Filed: Jan. 11, 2018

(65) Prior Publication Data

US 2018/0126745 A1 May 10, 2018

Related U.S. Application Data

(63) Continuation of application No. 15/426,853, filed on Feb. 7, 2017, now Pat. No. 9,902,164.

(30) Foreign Application Priority Data

Feb. 9, 2016 (JP) ..... 2016-022787

(51) Int. Cl.
*B41J 2/18* (2006.01)
*B41J 2/175* (2006.01)
(Continued)

(52) U.S. Cl.
CPC ..... *B41J 2/17563* (2013.01); *B41J 2/1752* (2013.01); *B41J 2/1753* (2013.01);
(Continued)

(58) Field of Classification Search
CPC ..... B41J 2/17563; B41J 2/17513; B41J 2/17556; B41J 2/18; B41J 2202/12;
(Continued)

(56) References Cited

U.S. PATENT DOCUMENTS 5,936,650 A * 8/1999 Ouchida ..... B41J 2/175 347/89
6,139,138 A 10/2000 Powers et al.
(Continued)

FOREIGN PATENT DOCUMENTS

JP 02281960 11/1990
JP 08207308 8/1996
(Continued)

OTHER PUBLICATIONS

Notice of Allowance issued in U.S. Appl. No. 15/426,853 dated Nov. 1, 2017.
(Continued)

*Primary Examiner* — Manish S Shah
(74) *Attorney, Agent, or Firm* — Workman Nydegger

(57) ABSTRACT

A liquid accommodation body that is removably installed in a liquid ejecting apparatus provided with a supply flow channel that supplies a liquid to a liquid ejecting portion, and a feedback flow channel that is connected to the supply flow channel so as to form a circulation flow channel, and is provided with a liquid accommodation portion that accommodates the liquid, a lead-out flow channel that connects a lead-out port, which is connected to the supply flow channel, and the feedback flow channel, an introduction flow channel that connects an introduction port, which is connected to the feedback flow channel, and the lead-out flow channel, and a filter portion that is provided in a partial circulation flow channel, which, among portions of the lead-out flow channel and the introduction flow channel, configures the circulation flow channel, and filters the liquid.

12 Claims, 9 Drawing Sheets

(51) Int. Cl.
*B41J 2/19* (2006.01)
*B41J 29/02* (2006.01)

(52) U.S. Cl.
CPC ..... *B41J 2/17513* (2013.01); *B41J 2/17523* (2013.01); *B41J 2/17546* (2013.01); *B41J 2/17556* (2013.01); *B41J 2/17596* (2013.01); *B41J 2/18* (2013.01); *B41J 2/19* (2013.01); *B41J 29/02* (2013.01)

(58) Field of Classification Search
CPC .... B41J 2/1752; B41J 2/17523; B41J 2/1753; B41J 2/17546; B41J 2/17596; B41J 2/19; B41J 29/02
See application file for complete search history.

(56) References Cited

U.S. PATENT DOCUMENTS 6,270,211 B1 * 8/2001 Long ..... B41J 2/17503 347/92
8,398,218 B2 * 3/2013 Tsukamura ..... B41J 2/175 347/85
8,770,730 B2 * 7/2014 Nanjo ..... B41J 2/17509 347/85
8,770,731 B2 * 7/2014 Miyashita ..... B41J 2/17509 347/85
9,272,521 B2 * 3/2016 Aoki ..... B41J 2/17563
9,724,930 B2 * 8/2017 Enomoto ..... B41J 2/17596
2002/0063759 A1 5/2002 Hirano
2006/0152562 A1 7/2006 Ohishi
2008/0170108 A1 * 7/2008 Lee ..... B41J 2/17509 347/85
2012/0139992 A1 * 6/2012 Kawabata ..... B41J 2/175 347/19
2013/0307910 A1 11/2013 Matsuhita et al.
2014/0320571 A1 * 10/2014 Enomoto ..... B41J 2/175 347/89
2015/0085035 A1 * 3/2015 Aoki ..... B41J 2/17563 347/93
2017/0225481 A1 8/2017 Iwamuro et al.

FOREIGN PATENT DOCUMENTS

JP 10175307 6/1998
JP 2004050472 2/2004
JP 2006192638 7/2006
JP 2014031017 2/2017

OTHER PUBLICATIONS

Office Action issued in U.S. Appl. No. 15/426,856 dated Jul. 21, 2017.

* cited by examiner

LIQUID ACCOMMODATION BODY AND LIQUID EJECTING APPARATUS

BACKGROUND

1. Technical Field

The present invention relates to a liquid accommodation body that accommodates an ink or the like, and a liquid ejecting apparatus that performs printing by ejecting an ink onto a medium.

2. Related Art

In the related art, ink jet recording apparatuses that are provided with a liquid accommodation body (an ink tank) in which a liquid (an ink) is accommodated, a liquid ejecting portion (a recording head portion) that ejects the liquid, and a supply flow channel (an ink supply channel) through which the liquid is supplied to the liquid ejecting portion from the liquid accommodation body, and that perform printing by ejecting the liquid toward a medium from the liquid ejecting portion, are known as an example of a liquid ejecting apparatus.

Among such liquid ejecting apparatuses, there are liquid ejecting apparatuses that are provided with a feedback flow channel (an ink flow channel) in which a circulation flow channel of the liquid is formed by connecting the supply flow channel and the liquid accommodation body, and a filter that filters the liquid that flows through the feedback flow channel. Further, in a case in which foreign matter is incorporated inside the supply flow channel, it is possible to remove the foreign matter by circulating the liquid together with the foreign matter using the supply flow channel and the feedback flow channel (for example, JP-A-2004-50472).

However, in the above-mentioned liquid ejecting apparatus, after being filtered by the filter, the liquid that flows through the feedback flow channel converges with liquid that is accommodated in a liquid accommodation portion. Therefore, there is a concern that the quality of the liquid that is accommodated in the liquid accommodation portion will deteriorate as a result of the liquid that is supplied toward the liquid ejecting portion from the liquid accommodation portion, and the liquid in a state of being accommodated in the liquid accommodation portion mixing together.

Additionally, this kind of circumstance is not limited to ink jet printers, and is largely common to liquid ejecting apparatuses in which liquid that flows through a circulation flow channel is returned to a liquid accommodation body after being filtered.

SUMMARY

An advantage of some aspects of the invention is to provide a liquid accommodation body and a liquid ejecting apparatus that can suppress a circumstance in which the quality of liquid that is accommodated deteriorates in a liquid accommodation body provided with a filter that filters a liquid, which flows through a circulation flow channel.

Hereinafter, means of the invention and operation effects thereof will be described.

According to an aspect of the invention, there is provided a liquid accommodation body that is removably installed in a liquid ejecting apparatus provided with a supply flow channel that is connected to a liquid ejecting portion, which ejects a liquid, in a manner in which it is possible to supply the liquid, and a feedback flow channel that is connected to the supply flow channel so as to form a circulation flow channel, which circulates the liquid, together with the supply flow channel, the liquid accommodation body including a liquid accommodation portion that accommodates the liquid, a lead-out port that is connected to the supply flow channel, a lead-out flow channel that connects the liquid accommodation portion and the lead-out port, an introduction port that is connected to the feedback flow channel, an introduction flow channel that connects the introduction port and the lead-out flow channel, and a filter portion that is provided in a partial circulation flow channel, which, among portions of the lead-out flow channel and the introduction flow channel, configures the circulation flow channel, and includes a filter that filters the liquid.

In this configuration, since the liquid accommodation body is provided with the filter portion, which includes a filter, the filter portion can also be replaced by replacing the liquid accommodation portion. In addition, the filter portion is provided in the liquid accommodation portion in a flow channel (the partial circulation flow channel) that, among portions of the lead-out flow channel and the introduction flow channel, configures the circulation flow channel. Therefore, when a circulation action, which circulates the liquid via the circulation flow channel, is performed, it is difficult for the liquid that passes through the filter portion to flow into the liquid accommodation portion, and therefore, it is possible to suppress a deterioration in the quality of the liquid inside the liquid accommodation portion.

In addition, in the liquid accommodation body, it is preferable that the filter portion be filled with the liquid in advance.

In a case in which the filter portion is not filled with the liquid, that is, in a case in which the filter portion is filled with a gaseous body, there is a concern that air bubbles will become incorporated in the supply flow channel, and the like, as a result of performing the circulation action. For this reason, in this case, since the filter portion is filled with the liquid in advance, even in a case in which the circulation action is performed, it is possible to reduce the concern that air bubbles will become incorporated in the supply flow channel, and the like.

In addition, in the liquid accommodation body, it is preferable that the filter portion include an introduction port side filter chamber on a side of the introduction port of the filter, a lead-out port side filter chamber on a side of the lead-out port of the filter, a flow inlet that is in communication with the introduction port side filter chamber and the partial circulation flow channel, and an outflow port that is in communication with the lead-out port side filter chamber and the partial circulation flow channel, and that the outflow port be disposed in a position that is closer to a lowermost portion of the lead-out port side filter chamber than to an uppermost portion thereof in a state of being installed in the liquid ejecting apparatus.

In a case in which air bubbles are incorporated in the lead-out port side filter chamber, it is easy for the air bubbles to remain in the uppermost portion of the lead-out port side filter chamber as a result of rising inside the lead-out port side filter chamber. Therefore, in a case in which the outflow port is provided in the uppermost portion of the lead-out port side filter chamber, there is a concern that air bubbles that remain in the uppermost portion of the lead-out port side filter chamber will be discharged into the supply flow channel. For this reason, in this case, the outflow port is disposed in a position that is closer to a lowermost portion of the lead-out port side filter chamber than to an uppermost portion thereof. Therefore, it is possible to reduce the concern that air bubbles that remain in the uppermost portion of the lead-out port side filter chamber will be discharged into the supply flow channel.

In addition, it is preferable that the liquid accommodation body further include a check valve, which regulates flow through of the liquid in a direction that is opposite to a lead-out direction, further on a liquid accommodation portion side than a connection position of the lead-out flow channel and the introduction flow channel when, in the lead-out flow channel, a direction that runs toward the lead-out port from the liquid accommodation portion is set as the lead-out direction.

In this configuration, it is possible to further suppress a circumstance in which the liquid that passes through the filter portion flows into the inside of the liquid accommodation portion. Therefore, it is possible to further suppress a circumstance in which the quality of the liquid inside the liquid accommodation portion deteriorates.

According to another aspect of the invention, there is provided a liquid ejecting apparatus including a liquid ejecting portion that ejects a liquid, a supply flow channel that is connected to the liquid ejecting portion in a manner in which it is possible to supply the liquid, a feedback flow channel that is connected to the supply flow channel so as to form a circulation flow channel, which circulates the liquid, together with the supply flow channel, a flow mechanism that causes a fluid inside the circulation flow channel to flow, an installation portion in which the above-mentioned liquid accommodation body is installed, and a control portion that causes the fluid inside the circulation flow channel to flow by driving the flow mechanism in a state in which the liquid accommodation body is installed in the installation portion.

In this configuration, in the liquid ejecting apparatus, it is possible to obtain the above-mentioned operation effects.

In addition, in the liquid ejecting apparatus, it is preferable that the control portion cause the liquid inside the feedback flow channel to flow in a feedback direction by driving the flow mechanism before the liquid is ejected from the liquid ejecting portion in a case in which the liquid accommodation body is installed in the installation portion when, in the feedback flow channel, a direction that runs toward the liquid accommodation body from the liquid ejecting portion is set as the feedback direction.

In this configuration, when the liquid accommodation body is installed in the installation portion, the circulation action is performed by causing the liquid inside the feedback flow channel to flow in the feedback direction. Therefore, it is possible to trap foreign matter such as air bubbles that are incorporated in the supply flow channel, and the like, during installation of the liquid accommodation body, in the filter of the filter portion. Accordingly, it is possible to improve the quality of the liquid that the liquid ejecting portion ejects, that is, the liquid that is supplied to the liquid ejecting portion.

In addition, in the liquid ejecting apparatus, it is preferable that the control portion cause the liquid inside the feedback flow channel to flow in a feedback direction by driving the flow mechanism in a case in which a liquid accommodation amount of the liquid accommodation portion is equal to or less than a stipulated value, which is smaller than an initial value, when, in the feedback flow channel, a direction that runs toward the liquid accommodation body from the liquid ejecting portion is set as the feedback direction.

In this configuration, in a case in which the liquid accommodation amount of the liquid accommodation portion reaches the stipulated value or less, the circulation action is performed by causing the liquid inside the feedback flow channel to flow in the feedback direction. Therefore, it is possible to trap foreign matter such as air bubbles that are incorporated in the circulation flow channel, in the filter of the filter portion before replacing the liquid accommodation body. Accordingly, since it is possible to replace the liquid accommodation body in a state in which there is little foreign matter that remains in the circulation flow channel, it is possible to efficiently use the filter portion, which is replaced together with the liquid accommodation body.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of a liquid ejecting apparatus will be described with reference to the drawings. Additionally, the liquid ejecting apparatus of the present embodiment is an ink jet printer that performs printing of characters and images on a medium by ejecting an ink, as an example of a liquid, onto a medium such as sheets of paper.

Figure 1:
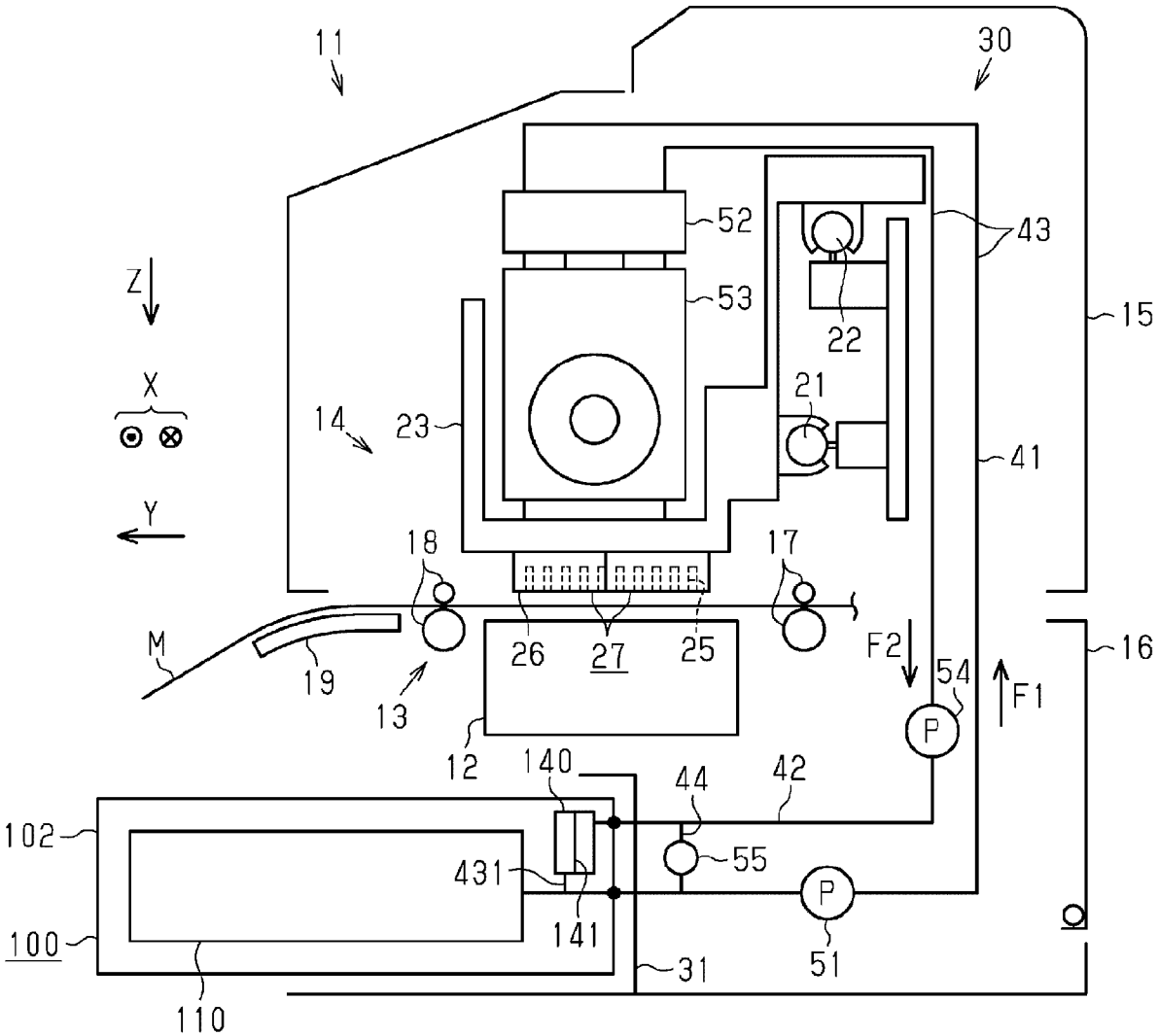
FIG. 1 is a side view that shows a schematic configuration of a liquid ejecting apparatus.

As shown in FIG. 1, a liquid ejecting apparatus 11 is provided with a transport portion 13 that transports a medium M, which is supported by a support platform 12, along the surface of the support platform 12 in a transport direction Y, and a liquid ejecting unit 14 that ejects a liquid onto the medium M that is transported.

The support platform 12, the transport portion 13, and the liquid ejecting unit 14 are assembled in an apparatus main body 15, which is configured by a housing, a frame, and the like. Additionally, the support platform 12 extends along the width direction (a direction that is orthogonal to the paper surface in FIG. 1) of the medium M in the liquid ejecting apparatus 11. In addition, a cover 16 is attached to the apparatus main body 15 so as to be capable of opening and closing.

The transport portion 13 is provided with pairs of transport rollers 17 and 18, which are respectively disposed on the upstream side and the downstream side of the support platform 12 in the transport direction Y. Furthermore, the transport portion 13 is provided with a guide plate 19, which is disposed on the downstream side of the pairs of transport rollers 17 and 18 in the transport direction Y and guides the medium M while supporting the medium M. Further, the transport portion 13 transports the medium M along the surface of the support platform 12 and the surface of the guide plate 19 as a result of the pairs of transport rollers 17 and 18 rotating while the medium M is held therebetween.

The liquid ejecting unit 14 is provided with guide shafts 21 and 22 that are disposed extending along a scanning direction X, which corresponds to the width direction of the medium M that is orthogonal to (intersects) the transport direction Y of the medium M, and a carriage 23 that is guided by the guide shafts 21 and 22 and is capable of reciprocating in the scanning direction X. Additionally, the carriage 23 moves in the scanning direction X in accordance with driving of a carriage motor 24 (refer to FIG. 2).

At least one (two in the present embodiment) liquid ejecting portion 27, which has a nozzle formation surface 26 in which nozzles 25 that eject a liquid (an ink) are formed, is attached to the lower end portion of the carriage 23. That is, the liquid ejecting portion 27 is attached to the carriage 23 in a posture in which the nozzle formation surface 26 faces the support platform 12 in a vertical direction Z with a predetermined pitch, and moves in the scanning direction X together with the carriage 23 in accordance with the driving of the carriage motor 24. Additionally, the liquid ejecting portions 27 are disposed so as to be separated from one another by a predetermined pitch in the scanning direction X and shifted from one another by a predetermined distance in the transport direction Y.

Figure 2:
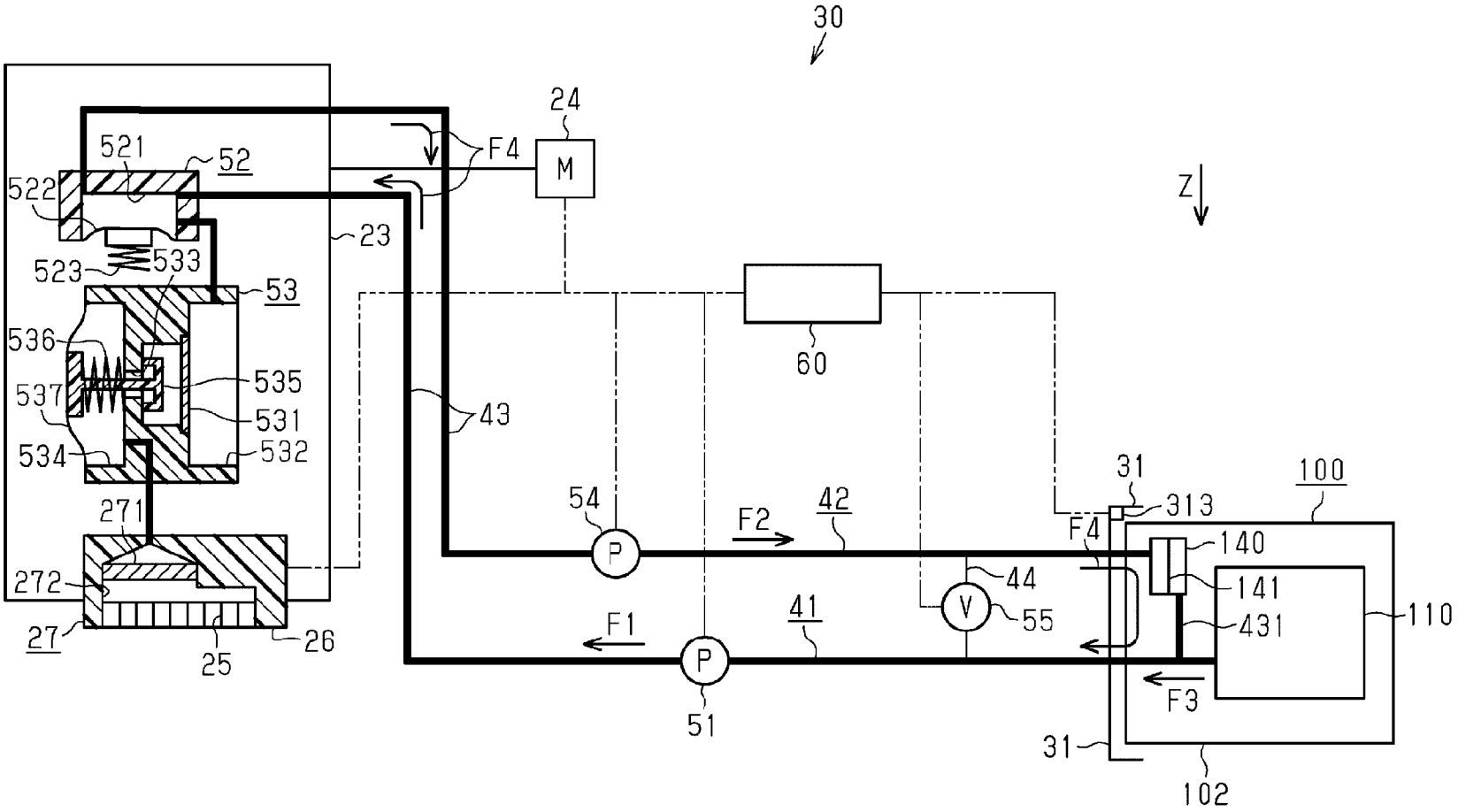
FIG. 2 is a lateral cross-sectional view that shows a schematic configuration of a supply flow channel of a liquid in the liquid ejecting apparatus.

On the other hand, as shown in FIGS. 1 and 2, a portion of a supply mechanism 30, which supplies a liquid to the liquid ejecting portion 27 from a liquid accommodation body 100 that accommodates the liquid, is attached to the upper side of the carriage 23. Additionally, at least one set (four sets in the present embodiment) of the supply mechanism 30 and the liquid accommodation body 100 is provided for each type of liquid.

In addition, as shown in FIGS. 1 and 2, an installation portion 31, in which the liquid accommodation body 100 is installed in a removable manner, is provided upstream of the supply mechanism 30. The installation portion 31 is provided for each type of liquid in the same manner as the liquid accommodation body 100. Additionally, in a case in which the liquid ejecting apparatus 11 is a printer, examples of a liquid that is accommodated in the liquid accommodation body 100 include a colored ink such as cyan ink, magenta ink, yellow ink, black ink or white ink, a functional liquid that adjusts a fixing state of the ink on the medium M, and the like.

As shown in FIG. 2, the supply mechanism 30 is provided with a supply flow channel 41 that supplies the liquid to the liquid ejecting portion 27 from the liquid accommodation body 100, a feedback flow channel 42 that forms a circulation flow channel 43, which circulates the liquid, together with the supply flow channel 41, and a diversion flow channel 44 (a bypass flow channel) that connects the supply flow channel 41 and the feedback flow channel 42, which form the circulation flow channel 43. That is, in the present embodiment, the feedback flow channel 42 is connected to the supply flow channel 41 so as to form the circulation flow channel 43 together with the supply flow channel 41.

As shown in FIG. 2, a supply pump 51 that causes the liquid inside the supply flow channel 41 to flow, a liquid accumulation chamber 52 in which the liquid is accumulated, and a pressure adjustment valve 53 for adjusting the pressure of the liquid, are provided in the supply flow channel 41.

For example, it is sufficient as long as the supply pump 51 is a diaphragm pump, or the like, and the supply pump 51 discharges liquid that is suctioned from the liquid accommodation body 100 side to the liquid ejecting portion 27 side. In this manner, the supply pump 51 supplies the liquid that is accommodated in the liquid accommodation body 100 toward the liquid ejecting portion 27. Additionally, in the description from this point onwards, the supply of the liquid to the liquid ejecting portion 27 due to driving of the supply pump 51 will also be referred to as a "supply action", and the flow direction of the liquid during the supply action will also be referred to as a "supply direction F1". In addition, the supply pump 51 of the present embodiment functions as a one-way valve that allows a circumstance in which the liquid is caused to flow in the supply direction F1 but restricts a circumstance in which the liquid is caused to flow in a direction that is opposite to the supply direction F1, when not being driven.

The liquid accumulation chamber 52 includes a concave portion 521 that is in communication with the supply flow channel 41 and the feedback flow channel 42, a flexible member 522 that blocks an opening of the concave portion 521, and a spring 523 that biases the flexible member 522 toward a direction in which the capacity of the liquid accumulation chamber 52 decreases. Further, by displacing the flexible member 522, the liquid accumulation chamber 52 alleviates fluctuations in the supply pressure of the liquid to the pressure adjustment valve 53 using the supply pump 51.

The pressure adjustment valve 53 is provided with a third filter 531 that filters the liquid that passes therethrough, a supply chamber 532 in which the third filter 531 is accommodated, a pressure chamber 534 that is in communication with the supply chamber 532 via a communication hole 533, a valve body 535 that is provided between the pressure chamber 534 and the supply chamber 532, and a spring 536 that biases the valve body 535 in a valve closing direction. That is, the valve body 535 is inserted through the communication hole 533, and the valve body 535, which is biased by the spring 536 is provided so as to block the communication hole 533.

The pressure chamber 534 is configured by a diaphragm 537 in which a portion of a wall surface thereof can be flexurally deformed along the biasing direction of the spring 536. The diaphragm 537 is subjected to a force that corresponds to external pressure (atmospheric pressure) on the outer surface side thereof, and is subjected to a force that corresponds to the pressure of the liquid inside the pressure chamber 534 on the inner surface side thereof. Accordingly, the diaphragm 537 is flexurally displaced in accordance with changes in a differential pressure of the pressure inside the pressure chamber 534 and the pressure that the diaphragm 537 is subjected to on the outer surface side thereof.

In addition, the supply chamber 532 is maintained in a pressurized state by the liquid that is supplied in a pressurized manner from the liquid accommodation body 100. Further, when the pressure inside the pressure chamber 534 is lower than the pressure that the diaphragm 537 is subjected to on the outer surface side thereof, and the differential pressure of the pressure inside the pressure chamber 534 and the pressure that the diaphragm 537 is subjected to on the outer surface side thereof is larger than a predetermined difference in pressure, the valve body 535 transitions from a state of regulating communication between the pressure chamber 534 and the supply chamber 532 due to the biasing force of the spring 536 to a state in which the pressure chamber 534 and the supply chamber 532 are in communication with one another. Subsequently, when the differential pressure of the pressure inside the pressure chamber 534 and the pressure that the diaphragm 537 is subjected to on the outer surface side thereof returns to a predetermined difference in pressure as a result of the liquid flowing into the pressure chamber 534 from the supply chamber 532, the valve body 535 regulates communication between the pressure chamber 534 and the supply chamber 532. In this manner, the pressure adjustment valve 53 adjusts the pressure of the liquid that is supplied to the liquid ejecting portion 27 via the supply flow channel 41 in order to maintain a supply pressure of the liquid to the liquid ejecting portion 27 at a predetermined pressure.

In addition, the liquid ejecting portion 27 includes a fourth filter 271 that filters the liquid that is supplied from the pressure adjustment valve 53, and a common liquid chamber 272 in which liquid to be supplied to the nozzles 25 is accumulated. The fourth filter 271 is a filter that is provided in the inner portion of the liquid ejecting portion 27 in order to filter the liquid that flows into the common liquid chamber 272.

As shown in FIG. 2, one end of the feedback flow channel 42 is connected to the liquid accumulation chamber 52, and the other end thereof is connected to the installation portion 31 (the liquid accommodation body 100). A circulation pump 54 is provided in the feedback flow channel 42 as an example of a "flow mechanism". For example, it is sufficient as long as the circulation pump 54 is configured by a gear pump, a diaphragm pump, or the like, and the circulation pump 54 discharges liquid that is suctioned from the liquid ejecting portion 27 side to the liquid accommodation body 100 side. Additionally, in the description from this point onwards, a direction in which the liquid is caused to flow in the feedback flow channel 42 as a result of driving of the circulation pump 54 will also be referred to as a "feedback direction F2".

As shown in FIG. 2, the diversion flow channel 44 connects a location in the supply flow channel 41 that is between the supply pump 51 and the installation portion 31, and a location in the feedback flow channel 42 that is between the circulation pump 54 and the installation portion 31. In addition, the diversion flow channel 44 is disposed along the vertical direction Z in a manner in which the vertical direction Z corresponds to the flow direction of the fluid. That is, the diversion flow channel 44 is a flow channel that connects the supply flow channel 41, which is disposed vertically below, and the feedback flow channel 42, which is disposed vertically above.

In addition, a switching valve 55, which switches a flow state of the fluid in the diversion flow channel 44 is provided in the diversion flow channel 44. In a case in which the supply pump 51 is driven and the liquid flows in the supply flow channel 41 in the supply direction F1, the switching valve 55 is opened so that air bubbles, which are included in the liquid that flows toward the liquid ejecting portion 27 from the liquid accommodation body 100, rise up the diversion flow channel 44 and are guided to the feedback flow channel 42. In addition, in a case in which the circulation pump 54 is driven and the liquid flows in the feedback flow channel 42 in the feedback direction F2, the switching valve 55 is closed so that the liquid that flows in the feedback flow channel 42 in the feedback direction F2 does not flow into the diversion flow channel 44, or in other words, so that the corresponding liquid flows in the inner portion of the liquid accommodation body 100.

Next, the installation portion 31 and the liquid accommodation body 100 of the liquid ejecting apparatus 11 will be described in detail with reference to FIG. 3. Additionally, the FIG. 3 is a view that partially illustrates a single liquid accommodation body 100 and a single installation portion 31 in which the corresponding single liquid accommodation body 100 is installed in a cross-sectional manner.

Figure 3:
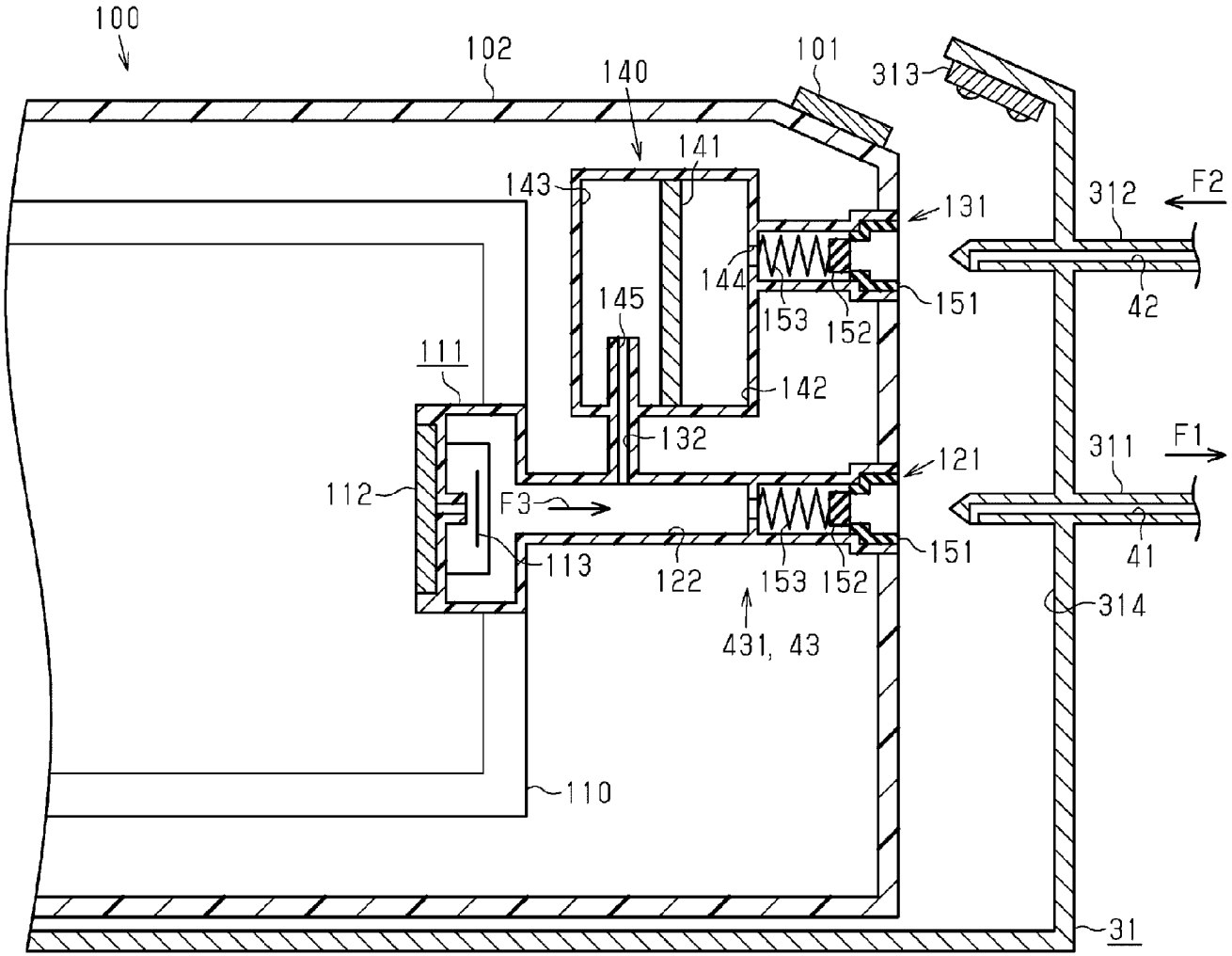
FIG. 3 is a lateral cross-sectional view that shows a state in which a liquid accommodation body is not installed in an installation portion.

As shown in FIG. 3, the installation portion 31 includes a supply needle 311 in which the supply flow channel 41 is formed, a feedback needle 312 in which the feedback flow channel 42 is formed, and a reading portion 313 that reads information that is stored on a storage element 101, which is attached to the liquid accommodation body 100.

In this instance, if a wall portion of the installation portion 31, which faces the liquid accommodation body 100 in a removal direction of the liquid accommodation body 100 with respect to the installation portion 31, is set as a facing wall portion 314, the supply needle 311 and the feedback needle 312 are formed in a projecting manner from the facing wall portion 314 so as to follow the removal direction. In addition, the supply needle 311 is formed vertically below the feedback needle 312. Further, the supply needle 311 is a component that configures one end of the supply flow channel 41, and the feedback needle 312 is a component that configures one end of the feedback flow channel 42.

The reading portion 313 is provided in a vertically upper portion of the facing wall portion 314, and is disposed vertically above the feedback needle 312. In addition, the reading portion 313 functions as an interface that connects the liquid ejecting apparatus 11 and the storage element 101. Additionally, the reading portion 313 may also have a function of writing information to the storage element 101. Furthermore, the reading portion 313 may be a component that reads information that is stored on the storage element 101 in a state of being in contact with the storage element 101, or may be a component that reads information that is stored on the storage element 101 using wireless communication in a state of not being in contact with the storage element 101.

As shown in FIG. 3, the liquid accommodation body 100 is provided with a housing 102 that configures the exterior thereof, a liquid accommodation portion 110 in which the liquid is accommodated, a lead-out port 121 that is connected to the supply flow channel 41, and a lead-out flow channel 122 that connects the liquid accommodation portion 110 and the lead-out port 121. In addition, the liquid accommodation body 100 is provided with an introduction port 131 that is connected to the feedback flow channel 42, an introduction flow channel 132 that connects the introduction port 131 and the lead-out flow channel 122, and a filter portion 140 that is provided in the introduction flow channel 132.

The housing 102 has a substantially rectangular parallelepiped form. In addition, in the housing 102, when the liquid accommodation body 100 is installed in the installation portion 31, the storage element 101 is provided in a location that faces the reading portion 313. The storage element 101 stores information related to a liquid accommodation amount of the liquid accommodation portion 110, which changes in accordance with usage of the liquid ejecting apparatus 11, stores information related to the type of the corresponding liquid, and the like. In addition, among constituent members of the liquid accommodation body 100, the liquid accommodation portion 110, the lead-out flow channel 122, the introduction flow channel 132, and the filter portion 140 are accommodated in the housing 102.

The liquid accommodation portion 110 has a bag form that is formed using an elastic material. As one example, the liquid accommodation portion 110 may be formed in a bag form by bonding the outer edges of a plurality of film members together. In addition, a lead-out portion 111, which is connected to the lead-out flow channel 122 and leads out the liquid that is accommodated in the inner portion of the liquid accommodation portion 110 to an outer portion thereof, is provided in the liquid accommodation portion 110.

The lead-out portion 111 includes a second filter 112 that filters the liquid that is led out to the outer portion of the liquid accommodation portion 110 from the inner portion thereof, and a check valve 113 that allows leading-out of the liquid from the liquid accommodation portion 110 but restricts introduction of the liquid to the liquid accommodation portion 110. In this instance, due to the fact that the check valve 113 is provided in the lead-out portion 111 of the liquid accommodation portion 110, it can be said that the check valve 113 is provided further on the liquid accommodation portion 110 side than a connection position of the lead-out flow channel 122 and the introduction flow channel 132. In addition, in the lead-out flow channel 122, if a direction that follows the lead-out port 121 from the liquid accommodation portion 110 is set as a "lead-out direction F3", the check valve 113 is a component that regulates flow-through of the liquid in a direction that is opposite to the lead-out direction F3 in the lead-out flow channel 122.

A sealing member 151 that suppresses leaking of the liquid from the lead-out port 121 and the introduction port 131, a valve member 152, which restricts flow of the liquid via the lead-out port 121 and the introduction port 131, and a spring member 153 that biases the valve member 152 toward the sealing member 151, are provided in the lead-out port 121 and the introduction port 131. Therefore, in a case in which the liquid accommodation body 100 is not installed in the installation portion 31, in the lead-out port 121 and the introduction port 131, a circumstance in which the liquid that is stored in the liquid accommodation body 100 leaks out from the lead-out port 121 and the introduction port 131, is suppressed as a result of the valve member 152 blocking the opening of the sealing member 151.

In addition, in the present embodiment, a portion of the flow channels of the lead-out flow channel 122 and all of the flow channels of the introduction flow channel 132 configure the circulation flow channel 43 together with the supply flow channel 41 and the feedback flow channel 42. Further, in the description from this point onwards, among the lead-out flow channel 122 and the introduction flow channel 132, the flow channels that configure the circulation flow channel 43 will also be referred to as a "partial circulation flow channel 431". That is, in the present embodiment, the partial circulation flow channel 431 is the circulation flow channel 43, which is formed in the inner portion of the liquid accommodation body 100.

The filter portion 140 includes a first filter 141 that filters the liquid that passes therethrough, an introduction port side filter chamber 142 that is formed on the introduction port 131 side when viewed from the first filter 141, and a lead-out port side filter chamber 143 that is formed on the lead-out port 121 side when viewed from the first filter 141. In addition, the filter portion 140 includes an inflow port 144 that allows communication between the introduction port side filter chamber 142 and the introduction flow channel 132 (the partial circulation flow channel 431), and an outflow port 145 that allows communication between the lead-out port side filter chamber 143 and the introduction flow channel 132 (the partial circulation flow channel 431). Additionally, due to the fact that the filter portion 140 is provided in the introduction flow channel 132, it can be said that the filter portion 140 is provided in the partial circulation flow channel 431.

In the introduction port side filter chamber 142 and the lead-out port side filter chamber 143, the inflow port 144 is open in a position that is vertically above the outflow port 145. In addition, in a state in which the liquid accommodation body 100 is installed in the installation portion 31, the outflow port 145 is open in a position that is closer in the vertical direction Z to the lowermost portion of the lead-out port side filter chamber 143 than to the uppermost portion thereof, and a position that is further in an upper portion than the bottom surface of the lead-out port side filter chamber 143.

The first filter 141 is disposed in the removal direction of the liquid accommodation body 100 with respect to the installation portion 31, which is a direction that intersects the vertical direction Z, so as to separate the introduction port side filter chamber 142 and the lead-out port side filter chamber 143. In addition, it is preferable that the introduction port side filter chamber 142 and the lead-out port side filter chamber 143 be filled with the same type of liquid as the liquid that is accommodated in the liquid accommodation portion 110. The same applies to the lead-out flow channel 122 and the introduction flow channel 132 that are connected to the filter portion 140.

Figure 4:
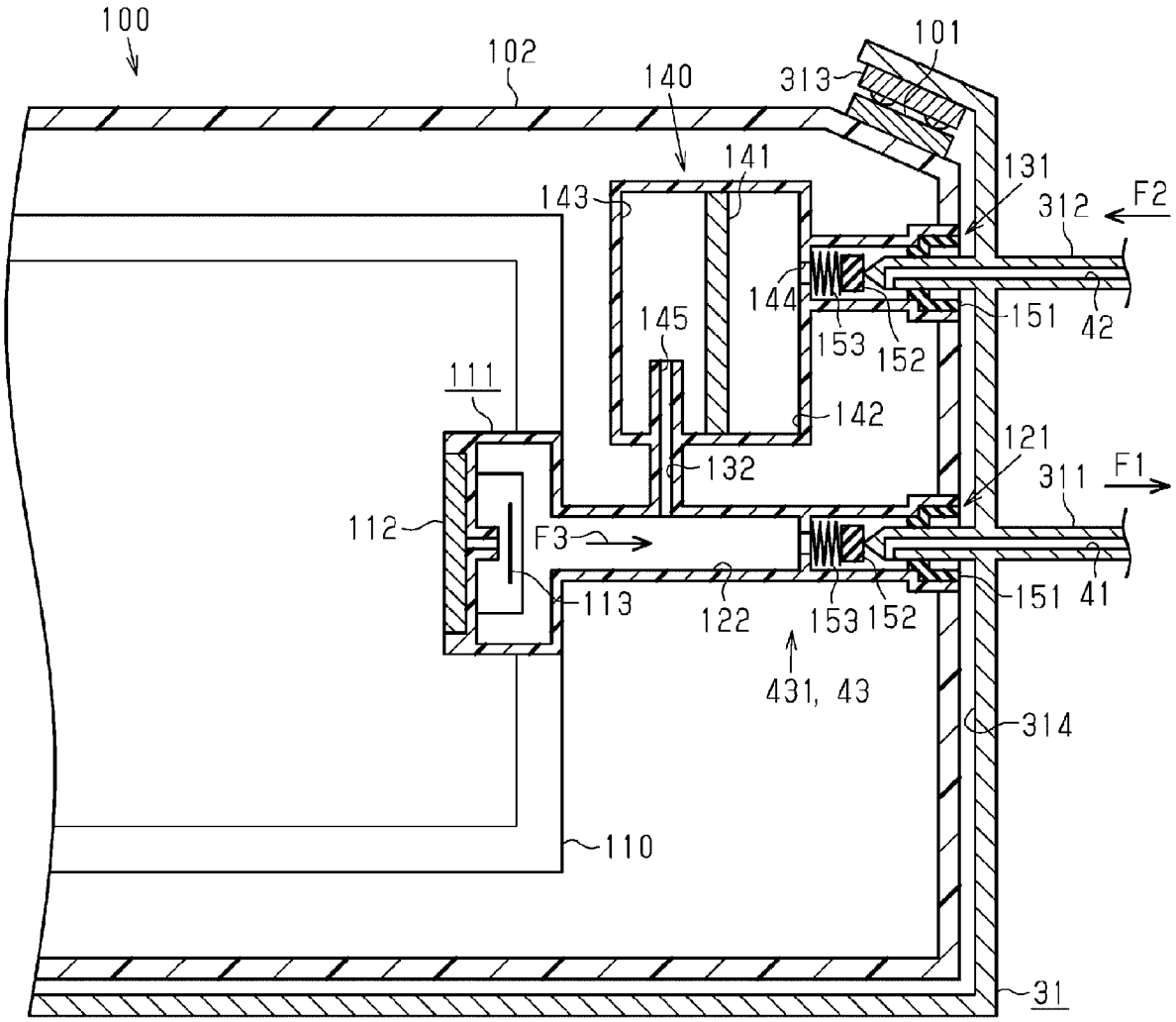
FIG. 4 is a lateral cross-sectional view that shows a state in which the liquid accommodation body is installed in the installation portion.

Further, as shown in FIG. 4, when the liquid accommodation body 100 is installed in the installation portion 31 of the liquid ejecting apparatus 11, a pressing force is applied to the valve member 152 of the lead-out port 121 by the supply needle 311, and a pressing force is applied to the valve member 152 of the introduction port 131 by the feedback needle 312. In this manner, in the lead-out port 121 and the introduction port 131, as a result of the valve member 152 reaching an open state from a state of blocking the sealing member 151, the supply flow channel 41 and the lead-out flow channel 122 are brought into communication with one another, and the feedback flow channel 42 and the introduction flow channel 132 are brought into communication with one another. In addition, the storage element 101 of the liquid accommodation body 100 reaches a state of being in contact with the reading portion 313 of the installation portion 31.

In this manner, as shown in FIG. 2, in the present embodiment, the circulation flow channel 43 of the liquid is configured to include the circulation flow channel 43, the feedback flow channel 42, and the partial circulation flow channel 431. Further, the circulation pump 54 and the filter portion 140 are provided in the circulation flow channel 43. Therefore, as a result of causing the liquid to flow due to driving of the circulation pump 54, the liquid that is circulated in the circulation flow channel 43, passes through the filter portion 140, and foreign matter such as air bubbles that are included in the liquid, is removed. Additionally, in the description from this point onwards, a direction in which the liquid flows in the circulation flow channel 43 as a result of driving of the circulation pump 54, will also be referred to as a "circulation direction F4", and a circumstance in which the liquid is caused to flow in the circulation direction F4 will also be referred to as a "circulation action".

Additionally, the circulation direction F4 is the supply direction F1, and is also the feedback direction F2. That is, in the circulation action, the liquid inside the supply flow channel 41 is caused to flow in the supply direction F1, and the liquid inside the feedback flow channel 42 is caused to flow in the feedback direction F2.

In addition, as shown in FIG. 2, the liquid ejecting apparatus 11 is provided with a control portion 60 that controls the apparatus integrally. The control portion 60 controls driving of the constituent members of the liquid ejecting apparatus 11 such as the carriage motor 24, the liquid ejecting portion 27, the supply pump 51, the circulation pump 54, and the switching valve 55. In this manner, the control portion 60 causes the liquid to be ejected from the liquid ejecting portion 27 in conjunction with transport of the medium M, causes the supply action to be performed, causes the circulation action to be performed, and the like. In addition, the control portion 60 acquires the information that is stored on the storage element 101 of the liquid accommodation body 100 via the reading portion 313.

Next, the specifications of the first filter 141 of the liquid accommodation body 100, the second filter 112 of the liquid accommodation portion 110, the third filter 531 of the pressure adjustment valve 53, and the fourth filter 271 of the liquid ejecting portion 27 will be described.

Firstly, for example, the respective filters 112, 141, 271, and 531 are formed using mesh-like body such as net made from a metal or a resin, a porous body, or a metal plate in which fine through holes are drilled. Examples of a specific mesh state include a metal mesh filter, a metal fiber, a metal sintered filter in which an SUS fine wire is configured into a felt form or is compressed and sintered for example, an electroformed metal filter, an electron beam processing metal filter, a laser beam machining metal filter, and the like.

In addition, in order to ensure that foreign matter in the liquid does not reach the openings of the nozzles 25 (hereinafter, referred to as "nozzle openings"), it is preferable that the filter grain size of the respective filters 112, 141, 271, and 531 be set to 15 μm (0.015 mm), which is smaller than the diameter of the nozzle openings, for example, 20 μm (0.020 mm). In addition, in a case in which stainless steel mesh filters are adopted as the filters, in order to ensure that foreign matter in the liquid does not reach the nozzle openings, it is preferable that the filter grain size of the filters be set to twill mat weave (filter grain size of 10 μm), which is smaller than the diameter of the nozzle openings (for example, 20 μm).

Further, it is preferable that the filter grain size of the first filter 141, which is accommodated in the liquid accommodation body 100 and can be replaced, be set to the same as or less than the filter grain sizes of the third filter 531 and the fourth filter 271, which are provided in the liquid ejecting apparatus. For example, in a case in which the filter grain sizes of the third filter 531 and the fourth filter 271 are set to twill mat weave (filter grain size of 10 μm), which is smaller than the diameter of the nozzle openings (for example, 20 μm), it is preferable that the first filter 141 be set to twill mat weave (filter grain size of 5 μm), the filter grain size of which is smaller than that of the third filter 531 and the fourth filter 271.

In addition, in the present embodiment, since the first filter 141, which is accommodated in the liquid accommodation body 100 is replaced as a result of replacing the liquid accommodation body 100, it is preferable that the specifications of the corresponding first filter 141 be decided on the basis of the liquid accommodation amount of the liquid accommodation body 100. To explain in more detail, it is preferable that the specifications of the first filter 141 be decided so as to reach the usage limit of the first filter 141 when the liquid accommodation amount of the liquid accommodation portion 110 runs low. According to such a configuration, even if the liquid accommodation body 100 is replaced as a result of the liquid accommodation amount of the liquid accommodation portion 110 being depleted, the first filter 141 is replaced in an optimum period.

Meanwhile, in the manner of the present embodiment, in the liquid ejecting apparatus 11 in which the liquid accommodation body 100 is installed in the installation portion 31, there are cases in which foreign matter such as air bubbles becomes incorporated in the flow channels such as the supply flow channel 41 and the lead-out flow channel 122 during installation of the liquid accommodation body 100. In this case, when the ejection (printing) of the liquid onto the medium M is initiated, there is a concern that it will no longer be possible for the liquid ejecting portion 27 to eject the liquid normally as a result of foreign matter being incorporated in the liquid ejecting portion 27 together with the liquid. In such an instance, in the present embodiment, the control portion 60 causes the circulation action to be performed in a case in which a liquid accommodation body 100 is installed anew in the installation portion 31.

Figure 5:
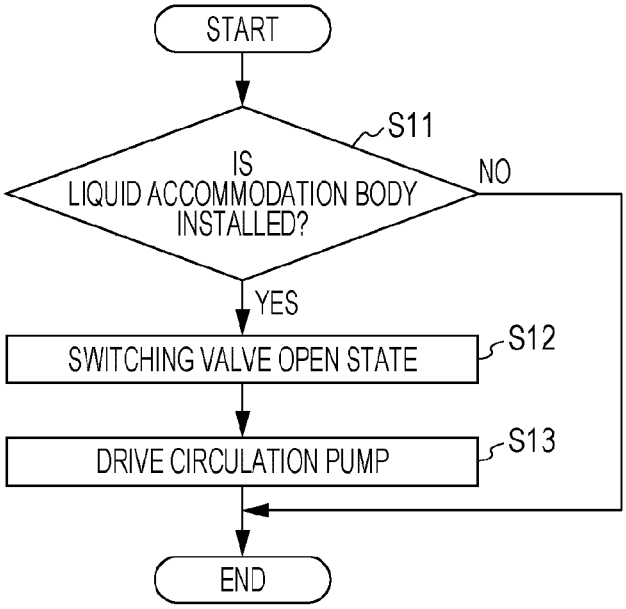
FIG. 5 is a flowchart that shows a process routine that a control portion executes in order to determine whether or not the liquid accommodation body is installed.

Next, a process routine that the control portion 60 executes during replacement of the liquid accommodation body 100 will be described with respect to the flowchart that is shown in FIG. 5. Additionally, the present process routine is a process routine that is executed in a predetermined control cycle in a case in which a liquid accommodation body 100 is not installed in the installation portion 31 of the liquid ejecting apparatus 11, and is a process routine that is executed for each of a plurality of liquid accommodation bodies 100.

As shown in FIG. 5, the control portion 60 determines whether or not a liquid accommodation body 100 is installed in an installation portion 31 in which a liquid accommodation body 100 is not installed (Step S11), and temporarily finishes the process routine in a case in which a liquid accommodation body 100 is not installed (Step S11: NO). On the other hand, in a case in which a liquid accommodation body 100 is installed (Step S11: YES), the control portion 60 sets a state in which it is possible for air bubbles to rise up in the diversion flow channel 44 by setting the switching valve 55 to an open state (Step S12). In this instance, the term "setting to an open state" refers to retaining an open state without change if the switching valve 55 is open, and opening if the switching valve 55 is closed. Further, the control portion 60 causes the circulation action to be performed by causing the liquid to flow in the feedback direction F2 in the feedback flow channel 42 as a result of driving the circulation pump 54 (Step S13).

In addition, in the present embodiment, in the above-mentioned manner, the filter portion 140, which is provided in the circulation flow channel 43, is a component that is replaced at the same time as replacement of the liquid accommodation body 100. Therefore, in a case in which a large amount of liquid is used continuously in a short period, or the like, irrespective of the fact that it is possible to continue use of the filter portion 140, there are cases in which the necessity to replace the liquid accommodation body 100 arises as a result of the liquid accommodation amount of the liquid accommodation portion 110 running low. In such an instance, in order to effectively utilize the filter portion 140 in such a case, the control portion 60 causes the circulation action to be performed before the liquid accommodation body 100 is detached.

Figure 6:
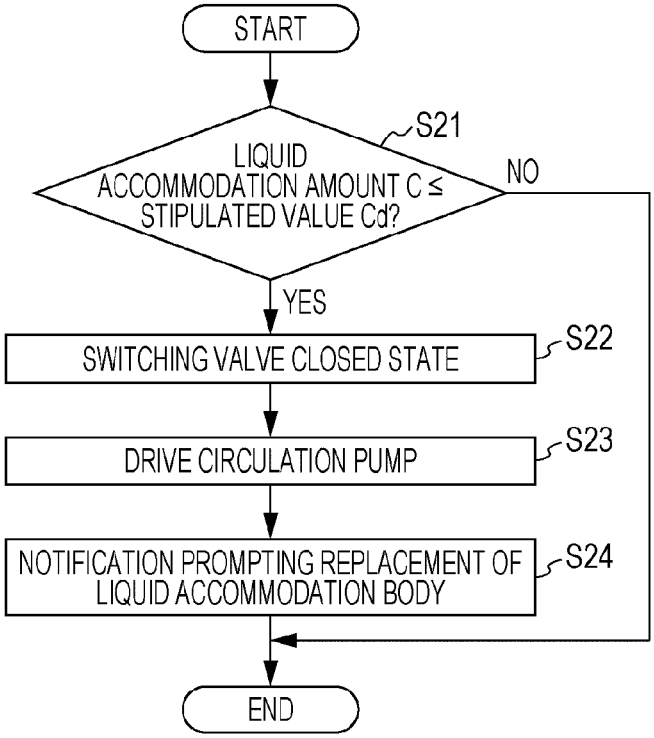
FIG. 6 is a flowchart that shows a process routine that a control portion executes in order to determine whether or not to replace the liquid accommodation body.

Next, a process routine that the control portion 60 executes during replacement of the liquid accommodation body 100 will be described with respect to the flowchart that is shown in FIG. 6. Additionally, the present process routine is a process routine that is executed for each predetermined control cycle, and is a process routine that is executed for each liquid accommodation body 100.

As shown in FIG. 6, the control portion 60 determines whether or not a liquid accommodation amount C of the liquid accommodation portion 110 is equal to or less than a stipulated value Cd (Step S21). Additionally, the liquid accommodation amount C of the liquid accommodation portion 110 may be calculated by counting the number of liquid droplets that are ejected from the liquid ejecting portion 27, or a measurement portion, which measures the liquid amount, may be provided in the liquid accommodation portion 110 and calculation may be performed on the basis of the measurement results of the measurement portion. In addition, the stipulated value Cd is an amount that is less than an initial value of the liquid accommodation amount C of the liquid accommodation portion 110, and at which the liquid of the liquid accommodation portion 110 is in a substantially depleted state. That is, a case in which the liquid accommodation amount C of the liquid accommodation portion 110 is equal to or less than the stipulated value Cd is a state in which it will no longer be possible to continue usage of the liquid ejecting apparatus 11 unless the liquid accommodation body 100 is replaced.

In a case in which the liquid accommodation amount C of the liquid accommodation portion 110 is greater than the stipulated value Cd (Step S21: NO), the control portion 60 temporarily finishes the present process routine. On the other hand, in a case in which the liquid accommodation amount C of the liquid accommodation portion 110 is equal to or less than the stipulated value Cd (Step S21: YES), the control portion 60 sets the switching valve 55 to a closed state (Step S22), and drives the circulation pump 54 (Step S23). In this instance, the term "setting to a closed state" refers to closing if the switching valve 55 is open, and retaining a closed state without change if the switching valve 55 is closed. In this manner, the control portion 60 causes the circulation action to be performed. Thereafter, the control portion 60 performs a notification for prompting replacement of the liquid accommodation body 100 (the filter portion 140) (Step S24), and temporarily finishes the present process routine.

Next, the actions of the liquid ejecting apparatus 11 of the present embodiment will be described.

Meanwhile, in the liquid ejecting apparatus 11, in a case in which the liquid is ejected onto the medium M, the liquid is supplied toward the liquid ejecting portion 27 from the liquid accommodation portion 110, and the liquid is ejected toward the medium M from the nozzles 25 of the liquid ejecting portion 27. In this instance, in a case in which air bubbles are included in the liquid that is supplied toward the liquid ejecting portion 27 from the liquid accommodation body 100, the corresponding air bubbles flow into the feedback flow channel 42 as a result of rising up the diversion flow channel 44. Therefore, it is difficult for the air bubbles to flow into the supply flow channel 41, and therefore, it is difficult for the air bubbles to become incorporated in the liquid ejecting portion 27.

In addition, when the liquid accommodation amount of the liquid accommodation body 100 reaches the stipulated value or less as a result of usage of the liquid ejecting apparatus 11 being continued, the circulation action is performed, and foreign matter inside the circulation flow channel 43 is trapped by the filter portion 140 (the first filter 141) of the liquid accommodation body 100. In addition, after the execution of the circulation action of the liquid, a notification for prompting replacement of the liquid accommodation body 100 is performed, and replacement work of the liquid accommodation body 100 is performed by a user of the liquid ejecting apparatus 11.

Further, when a new liquid accommodation body 100 is installed in the liquid ejecting apparatus 11, the circulation action is performed before the liquid is ejected toward the medium M from the liquid ejecting portion 27. Therefore, even if foreign matter such as air bubbles, is incorporated in the introduction port 131 and the lead-out port 121 of the liquid accommodation body 100 during installation of a new liquid accommodation body 100, the corresponding foreign matter is trapped by the filter portion 140 (the first filter 141) of the liquid accommodation body 100.

In addition, since the filter portion 140 of the liquid accommodation body 100 is filled with the liquid in advance, an action filling the filter portion 140 with the liquid is not performed before the circulation action is performed. That is, since the circulation action is performed quickly after replacement of the liquid accommodation body 100, the time required until restarting usage of the liquid ejecting apparatus 11 is shortened.

According to the abovementioned embodiment, it is possible to obtain the following effects.

(1) Since the liquid accommodation body 100 is provided with the filter portion 140, it is possible to replace the filter portion 140 by replacing the liquid accommodation body 100. In addition, the filter portion 140 is provided in the liquid accommodation portion 110 in a flow channel (the partial circulation flow channel 431) that, among portions of the lead-out flow channel 122 and the introduction flow channel 132, configures the circulation flow channel 43. Therefore, when the circulation action, which circulates the liquid via the circulation flow channel 43, is performed, it is difficult for the liquid that passes through the filter portion 140 to flow into the liquid accommodation portion 110, and therefore, it is possible to suppress a deterioration in the quality of the liquid inside the liquid accommodation portion 110.

(2) In a case in which the filter portion 140 is not filled with the liquid, that is, in a case in which the filter portion 140 is filled with a gaseous body, there is a concern that air bubbles will become incorporated in the supply flow channel 41, and the like, as a result of performing the circulation action. For this reason, since the filter portion 140 of the present embodiment is filled with the liquid in advance, in a case in which the circulation action is performed, it is possible to reduce the concern that air bubbles will become incorporated in the supply flow channel 41, and the like.

(3) In a case in which air bubbles are incorporated in the lead-out port side filter chamber 143, which is filled with the liquid, it is easy for the air bubbles to remain in the uppermost portion of the lead-out port side filter chamber 143 as a result of rising inside the lead-out port side filter chamber 143. Therefore, in a case in which the outflow port 145 is provided in the uppermost portion of the lead-out port side filter chamber 143, there is a concern that air bubbles that remain in the uppermost portion of the lead-out port side filter chamber 143 will be discharged into the supply flow channel 41 via the outflow port 145 and the partial circulation flow channel 431.

For this reason, according to the present embodiment, the outflow port 145 is open in a position that is closer to a lowermost portion of the lead-out port side filter chamber 143 than to an uppermost portion thereof. Therefore, it is possible to reduce the concern that air bubbles that remain in the uppermost portion of the lead-out port side filter chamber 143 will be supplied to the supply flow channel 41 via the outflow port 145 and the partial circulation flow channel 431.

(4) In a case in which the circulation action is performed by providing the check valve 113 further on the liquid accommodation portion 110 side than the connection position of the lead-out flow channel 122 and the introduction flow channel 132, or the like, it is possible to further suppress a circumstance in which the liquid that passes through the filter portion 140 flows inside the liquid accommodation portion 110. Therefore, it is possible to further suppress a circumstance in which the quality of the liquid inside the liquid accommodation portion 110 deteriorates.

(5) Since the circulation action is executed during installation of the liquid accommodation body 100 with respect to the installation portion 31, it is possible to trap foreign matter such as air bubbles, that is incorporated in the supply flow channel 41, and the like, due to the installation action of the liquid accommodation body 100, in the filter portion 140. Accordingly, it is possible to improve the quality of the liquid that the liquid ejecting portion 27 ejects, that is, the liquid that is supplied to the liquid ejecting portion 27.

(6) Since the circulation action is executed in a case in which the liquid accommodation amount of the liquid accommodation portion 110 is equal to or less than the stipulated value, it is possible to trap foreign matter such as air bubbles that is incorporated in the circulation flow channel 43, in the filter portion 140 before replacing the liquid accommodation body 100. Accordingly, since it is possible to replace the liquid accommodation body 100 in a state in which there is little foreign matter that remains in the circulation flow channel 43, it is possible to efficiently use the filter portion 140, which is replaced together with the liquid accommodation body 100.

(7) Since the diversion flow channel 44, which connects the supply flow channel 41 that is disposed vertically below and the feedback flow channel 42 that is disposed vertically above in the vertical direction Z, is provided, it is possible to cause air bubbles that are included in the liquid that flows in the supply flow channel 41 during the supply action to flow into the feedback flow channel 42 via the diversion flow channel 44. Accordingly, it is possible to reduce the amount of air bubbles that are included in the liquid to be supplied to the liquid ejecting portion 27.

(8) Since the switching valve 55 is provided in the diversion flow channel 44, it is possible to prevent a circumstance in which the liquid that flows in the feedback direction F2 in the feedback flow channel 42 flows into the diversion flow channel 44 by closing the switching valve 55 during the circulation action. That is, it is possible to cause the liquid that flows in the feedback direction F2 in the feedback flow channel 42 during the circulation action to flow into the liquid accommodation body 100, and to trap foreign matter such as air bubbles that are included in the corresponding liquid, in the filter portion 140 (the first filter 141).

Additionally, the abovementioned embodiment may be changed in the following manner.

The storage element 101 may store information related to the specifications of the first filter 141 of the liquid accommodation body 100. In this case, the control portion 60 may estimate the usage period of the first filter 141 on the basis of the information related to the first filter 141, which is stored in the storage element 101, and perform a notification for replacement of the first filter 141, that is, replacement of the liquid accommodation body 100 on the basis of the corresponding usage period.

If the storage element 101 forms a set with the liquid accommodation body 100, it may be possible to separate the storage element 101 from the liquid accommodation body 100. In this case, it is preferable that the liquid ejecting apparatus 11 be provided with a first installation portion of the installation portion 31 for installing the liquid accommodation body 100, and a second installation portion for installing the storage element 101. In addition, in a case in which the liquid leaks out from the first installation portion, in order to suppress a circumstance in which the liquid becomes attached to the second installation portion, it is preferable that the second installation portion be provided vertically above the first installation portion.

Figure 7:
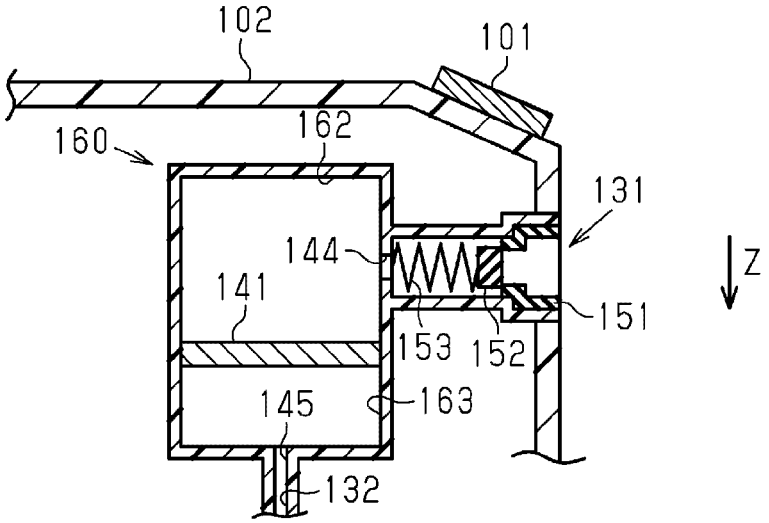
FIG. 7 is a lateral cross-sectional view that shows a filter portion according to a first modification example.

The filter portion 140 may be configured as a filter portion 160 that is shown in FIG. 7. That is, in a state in which the liquid accommodation body 100 is installed in the liquid ejecting apparatus 11, an introduction port side filter chamber 162 may be disposed vertically above a lead-out port side filter chamber 163. In this case, the outflow port 145 may be formed so as to be open in the bottom wall of the lead-out port side filter chamber 163.

Figure 8:
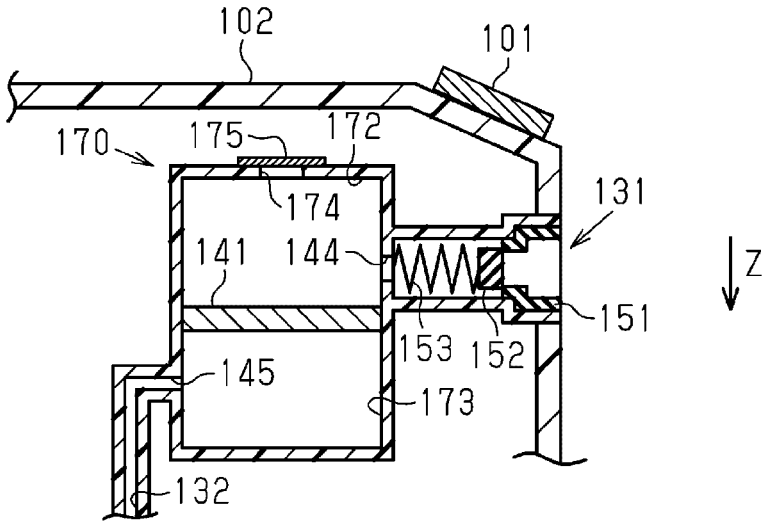
FIG. 8 is a lateral cross-sectional view that shows a filter portion according to a second modification example.

The filter portion 140 may be configured as a filter portion 170 that is shown in FIG. 8. That is, in the same manner as the filter portion 160, in a state in which the liquid accommodation body 100 is installed in the liquid ejecting apparatus 11, an introduction port side filter chamber 172 may be disposed vertically above a lead-out port side filter chamber 173. Further, a communication hole 174 that allows communication between the inside and the outside of the introduction port side filter chamber 172 may be provided in the upper wall of the corresponding introduction port side filter chamber 172, and the communication hole 174 may be blocked by a gas-liquid separating membrane 175.

According to such a configuration, as a result of executing the circulation action, air bubbles that are trapped in the first filter 141 remain in the vertically upper portion of the introduction port side filter chamber 172, that is, in a state of being in contact with the gas-liquid separating membrane 175. Therefore, it is possible to discharge air bubbles that are trapped by the first filter 141, from the introduction port side filter chamber 172 via the gas-liquid separating membrane 175. Additionally, in order to facilitate the discharge of air bubbles from the introduction port side filter chamber 172, the pressure on the outer side of the gas-liquid separating membrane 175 may be set to be lower than the pressure on the inner side (the introduction port side filter chamber 172 side) of the gas-liquid separating membrane 175.

Figure 9:
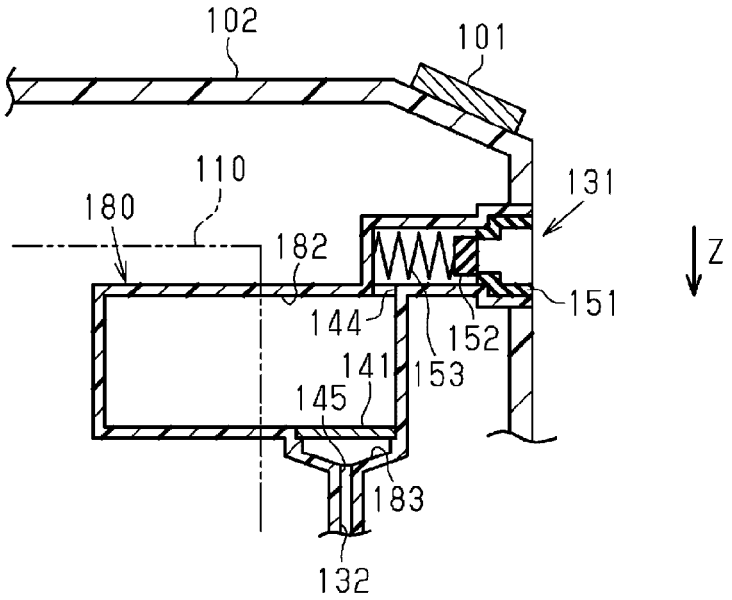
FIG. 9 is a lateral cross-sectional view that shows a filter portion according to a third modification example.

The filter portion 140 may be configured as a filter portion 180 that is shown in FIG. 9. That is, the capacity of an introduction port side filter chamber 182 may be set to be greater than the capacity of a lead-out port side filter chamber 183. Additionally, it is preferable that the capacity of the introduction port side filter chamber 182 be the capacity of the flow channels of the supply flow channel 41 and the feedback flow channel 42 of the supply mechanism 30 or more.

According to such a configuration, in a case in which initial filling, which fills the supply flow channel 41 and the feedback flow channel 42 with the liquid, is performed in a state in which the supply flow channel 41 and the feedback flow channel 42 of the supply mechanism 30 are not filled with the liquid, it is possible for the gaseous body (the air) inside the supply flow channel 41 and the feedback flow channel 42 to be accommodated in the introduction port side filter chamber 182 as a result of performing the circulation action. That is, in a case in which initial filling is performed, it is not necessary to perform an action that discharges the gaseous body inside the supply flow channel 41 and the feedback flow channel 42 from the nozzles 25 by applying a negative pressure to the corresponding nozzles 25 of the liquid ejecting portion 27.

Additionally, in the filter portion 180 that is shown in FIG. 9, as shown by the dashed-two dotted line, the introduction port side filter chamber 182 and the liquid accommodation portion 110 may be provided so as to overlap with one another. According to such a configuration, it is possible to suppress a circumstance in which an upper limit value of the liquid accommodation amount of the liquid accommodation portion 110 decreases as a result of a region in which the liquid accommodation portion 110 is accommodated being compressed by the introduction port side filter chamber 182.

Figure 10:
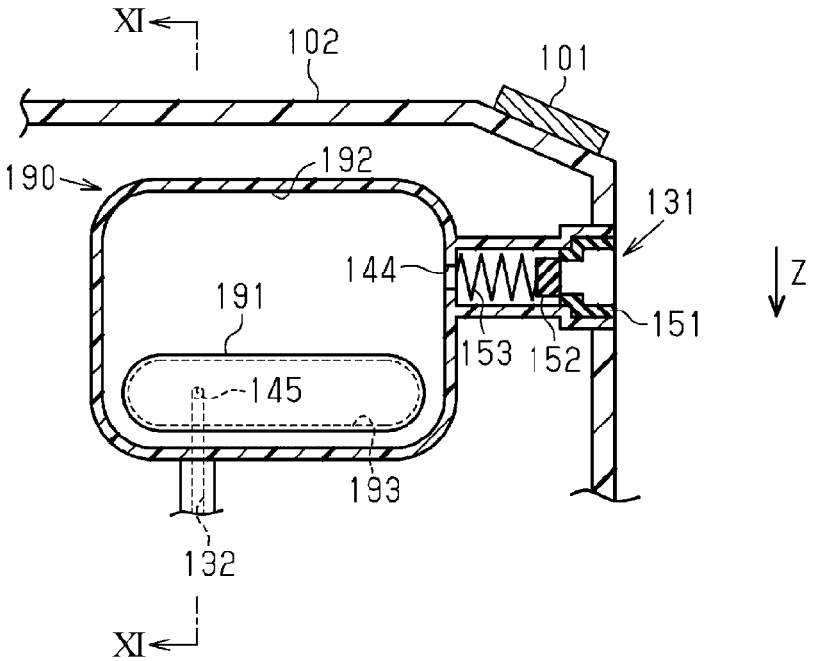
FIG. 10 is a lateral cross-sectional view that shows a filter portion according to a fourth modification example.
Figure 11:
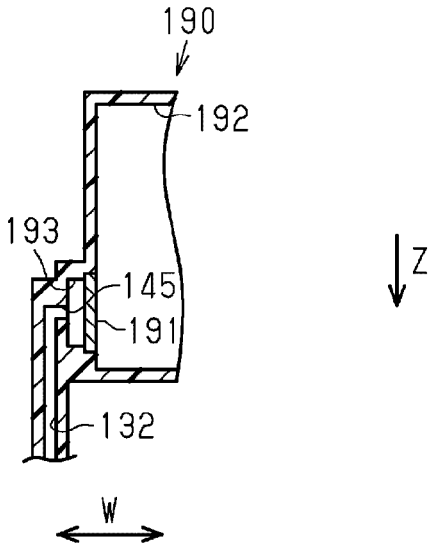
FIG. 11 is a partial cross-sectional view along the arrow direction of the line XI-XI in FIG. 10.

The filter portion 140 may be a filter portion 190 such as that shown in FIGS. 10 and 11. In this instance, in the filter portion 190, a first filter 191 partitions an introduction port side filter chamber 192 and a lead-out port side filter chamber 193 in a width direction W of the liquid accommodation body 100, which intersects (is orthogonal to) both directions of the installation direction of the liquid accommodation body 100 and the vertical direction Z. Therefore, it is possible to increase the surface area of the first filter 191 while suppressing an increase in size of the liquid accommodation body 100 in the width direction W.

The filter portion 140 and the partial circulation flow channel 431 need not necessarily be filled with the liquid. In this case, it is preferable that a filling action that fills the filter portion 140 and the partial circulation flow channel 431 with the liquid be performed after the liquid accommodation body 100 is installed in the installation portion 31 of the liquid ejecting apparatus 11.

Figure 12:
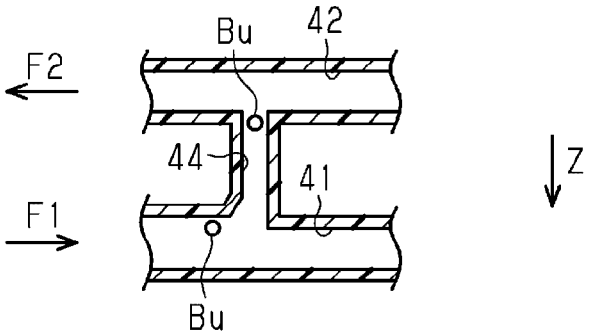
FIG. 12 is a cross-sectional view that shows a diversion flow channel according to a fifth modification example.

The switching valve 55 need not necessarily be provided in the diversion flow channel 44. In this case, as shown in FIG. 12, in the supply flow channel 41, it is preferable that the upper surface of the flow channel on the upstream side be made higher than the connection section with the diversion flow channel 44, and that the upper surface of the flow channel on the downstream side be made lower than the corresponding connection section. According to such a configuration, it is possible to facilitate inflow of air bubbles Bu that are included in the liquid that flows in the supply direction F1 in the supply flow channel 41, into the diversion flow channel 44.

A one-way valve (a check valve) that allows the flow of the liquid to the feedback flow channel 42 from the supply flow channel 41, but restricts the flow of the liquid to the supply flow channel 41 from the feedback flow channel 42, may be provided instead of the switching valve 55.

Figure 13:
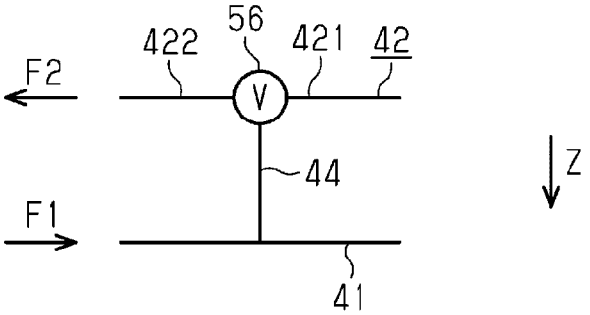
FIG. 13 is a cross-sectional view that shows a diversion flow channel according to a sixth modification example.

As shown in FIG. 13, a three-way valve 56 may be provided at the connection location of the feedback flow channel 42 and the diversion flow channel 44 instead of the switching valve 55. In this instance, in the feedback flow channel 42, using the three-way valve 56 as a reference, the flow channel on the liquid ejecting portion 27 side is set as a first feedback flow channel 421, and the flow channel on the installation portion 31 side is set as a second feedback flow channel 422. In addition, the three-way valve 56 is set to be switched between a state of only allowing communication between the first feedback flow channel 421 and the second feedback flow channel 422, and a state of only allowing communication between the first feedback flow channel 421 and the diversion flow channel 44. Further, in this case, it is preferable that the three-way valve 56 only allow communication between the first feedback flow channel 421 and the second feedback flow channel 422 during the circulation action.

Furthermore, in this case, as long as it is possible to supply the liquid that is led out from the lead-out port 121 of the liquid accommodation body 100 to the liquid ejecting portion 27 by causing the liquid to flow in a direction that is opposite to the feedback direction F2 in the feedback flow channel 42 as a result of reverse driving of the circulation pump 54, the following configuration may be used. That is, the supply action may be performed by supplying the liquid to the liquid ejecting portion 27 via the supply flow channel 41 and the circulation flow channel 43 as a result of only allowing communication between the first feedback flow channel 421 and the diversion flow channel 44 using the three-way valve 56. According to such a configuration, it is possible to stabilize the supply of the liquid with respect to the liquid ejecting portion 27, and to increase the supply amount, by simultaneously driving the supply pump 51 and the circulation pump 54 in parallel, by alternately driving the supply pump 51 and the circulation pump 54.

The diversion flow channel 44 need not necessarily be provided. In this case, an air bubble reservoir (a capture portion), which captures air bubbles, may be provided in the lead-out flow channel 122. It is sufficient as long as the air bubble reservoir is a space that is formed so as to extend upward from the lead-out flow channel 122.

Figure 14:
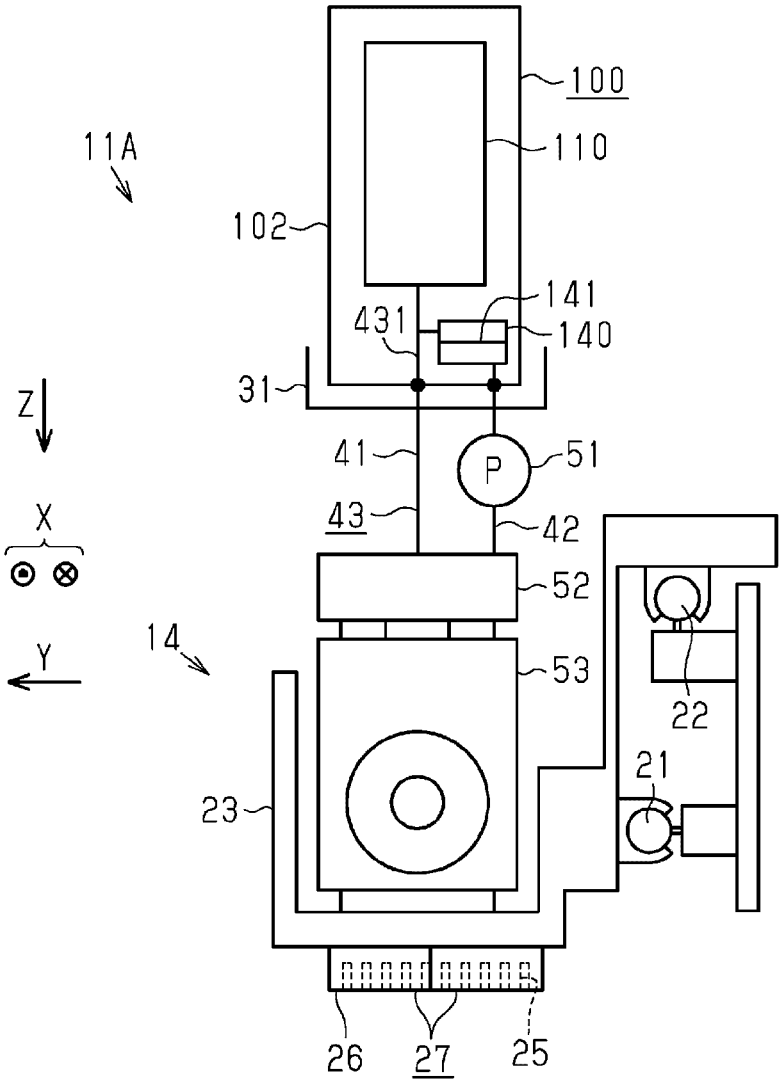
FIG. 14 is a side view that shows a liquid ejecting unit and a liquid accommodation body of a liquid ejecting apparatus according to a seventh modification example.

As shown in FIG. 14, the liquid ejecting apparatus 11 may also be a liquid ejecting apparatus 11A, which supplies liquid that is accommodated in the liquid accommodation body 100 to the liquid ejecting unit 14 using a water head difference. That is, in this case, the installation portion 31 is provided vertically above the liquid ejecting unit 14, and the liquid accommodation body 100 is installed in the corresponding installation portion 31. According to this configuration, it is possible to supply the liquid to the liquid ejecting portion 27 even if the supply pump 51, which supplies the liquid, is not provided.

A liquid accommodation body 100 for initial filling may be installed during initial filling, and the inside of the circulation flow channel 43 may be filled with the liquid while recovering the air inside the circulation flow channel 43 to the introduction port side filter chamber 142 of the filter portion 140 as a result of the circulation action. In this case, it is preferable that the capacity of the introduction port side filter chamber 142 at least be greater than the capacity of the circulation flow channel 43. In addition, the surface area of the first filter 141 of the filter portion 140 of the liquid accommodation body 100 may differ during initial filling and during normal usage, or may be equivalent.

The specifications of the filter portion 140 such as the surface area and the material of the first filter 141 may be changed depending on the type of the liquid that is accommodated in the liquid accommodation portion 110 of the liquid accommodation body 100.

The outflow port 145 may be formed so as to be open in the bottom surface of the lead-out port side filter chamber 143, or may be formed so as to be open in the upper surface of the lead-out port side filter chamber 143.

The circulation action may be executed at a predetermined timing that is set in advance, may be executed every predetermined time interval, or may be executed on the basis of an instruction from a user.

In the flowchart that is shown in FIG. 6, when the liquid is ejected toward the medium M from the liquid ejecting portion 27, the processes of Steps S22 to S24 may be executed after the ejection of the liquid with respect to the corresponding medium M is completed in a case in which the liquid accommodation amount C of the liquid accommodation portion 110 is equal to or less than the stipulated value Cd. In addition, the processes of Steps S22 to S24 may be executed by interrupting the ejection of the liquid with respect to the medium M.

The processes of Steps S22 and S23 in the flowchart that is shown in FIG. 6 may be executed in a case in which the liquid accommodation amount C of the liquid accommodation portion 110 is an amount that is less than the initial value of the liquid accommodation amount C of the liquid accommodation portion 110, and reaches a stipulated value Cn (a low ink threshold value), which is greater than the stipulated value Cd (an ink depletion threshold value). That is, the circulation action need not necessarily be performed immediately before replacement of the liquid accommodation body 100. In this case, Step S24 need not necessarily be performed. In addition, a notification of the fact that the liquid accommodation amount of the liquid accommodation body 100 is running low may be performed instead of Step S24.

In the flowchart that is shown in FIG. 6, the control portion 60 need not necessarily execute the processes of Step S22 and S23. That is, the circulation action need not necessarily be performed immediately before replacement of the liquid accommodation body 100.

In a case in which the reading portion 313 has a function of writing to the storage element 101, the date on which the liquid accommodation body 100 was installed, the amount of liquid that has been led out from the liquid accommodation body 100, the liquid accommodation amount (a residual amount) of the liquid accommodation body 100, and the like may be used as information that is written to the storage element 101. In addition, the liquid ejecting apparatus 11 (the control portion 60) may notify a user of warnings on the basis of the corresponding information.

The check valve 113 may be provided in the lead-out flow channel 122 between the liquid accommodation portion 110 and the connection location of the introduction flow channel 132 and the lead-out flow channel 122.

In addition, the check valve 113 need not necessarily be provided.

The liquid ejecting apparatus 11 may be a line head type liquid ejecting apparatus, which is provided with a line head in which the printing range spans the entire width of the medium M instead of being provided with the carriage 23, which holds the liquid ejecting portion 27.

The medium M is not limited to sheets of paper, and may be a plastic film, a thin plate material, or the like, may be a fabric that is used in textile printing, a garment such as a T-shirt, or may be a three-dimensional object such as stationery, or tableware.

The liquid that the liquid ejecting portion 27 ejects is not limited to ink, and for example, may be a liquid form body in which particles of a functional material are dispersed in the liquid or mixed together. For example, a configuration that performs recording by ejecting a liquid form body including a material such as an electrode material or a color material (a pixel material), which is used in the manufacture of a liquid crystal display, an electroluminescence (EL) display, a surface-emitting display, or the like, in a dispersed or dissolved form, may be used.

This application is a continuation of U.S. application Ser. No. 15/426,853, filed Feb. 7, 2017, which claims priority to Japanese Patent Application No. 2016-022787, filed Feb. 9, 2016 Both applications are expressly incorporated by reference herein.

What is claimed is:

1. A liquid ejecting apparatus comprising:

a liquid ejecting portion that ejects a liquid;

an installation portion designed to install an accommodation body accommodating the liquid;

a supply flow passage connecting the installation portion and the liquid ejecting portion for supplying the liquid toward the liquid ejecting portion;

a feedback flow passage connected to the supply flow passage on a side of the liquid ejecting portion from the installation portion, the feedback flow passage forming a circulation passage in cooperation with the supply flow passage and a partial circulation flow passage when the accommodation body is installed in the installation portion, the partial circulation flow passage being provided inside the accommodation body;

a flow mechanism that causes a fluid inside the circulation flow passage to flow; and a control portion that causes the fluid inside the circulation flow passage to flow by driving the flow mechanism in a state in which the accommodation body is installed in the installation portion.

2. The liquid ejecting apparatus according to claim 1, the accommodation body further includes a liquid accommodation portion that accommodates the liquid, the liquid accommodation portion being connected to the feedback flow passage via the partial circulation flow passage, wherein the control portion causes the fluid inside the circulation flow passage to flow in a feedback direction in which the liquid flows from the liquid ejecting portion toward the installation portion in the feedback flow passage by driving the flow mechanism before the liquid is ejected from the liquid ejecting portion in a case in which the accommodation body is installed in the installation portion.

3. The liquid ejecting apparatus according to claim 1, the accommodation body further includes a liquid accommodation portion that accommodates the liquid, wherein the control portion causes the fluid inside the circulation flow passage to flow in a feedback direction in which the liquid flows from the liquid ejecting portion toward the installation portion in the feedback flow passage by driving the flow mechanism in a case in which a liquid accommodation amount of the liquid accommodation portion is equal to or less than a stipulated value, which is smaller than an initial value of the liquid accommodation amount.

4. The liquid ejecting apparatus according to claim 1, further comprising:

a bypass flow passage connecting the supply flow passage and the feedback flow passage.

5. The liquid ejecting apparatus according to claim 4, wherein one end of the bypass flow passage connected to the supply flow passage is located below the other end of the bypass flow passage connected to the feedback flow passage.

6. The liquid ejecting apparatus according to claim 4, further comprising:

a switching valve provided in the bypass flow passage and switches a flow state of a fluid in the bypass flow passage.

7. The liquid ejecting apparatus according to claim 6, wherein the switching valve is opened in a case in which the liquid flows toward the liquid ejecting portion in the supply flow passage.

8. The liquid ejecting apparatus according to claim 6, wherein the switching valve is closed in a case in which the liquid flows toward the liquid ejecting portion in the supply flow passage.

9. The liquid ejecting apparatus according to claim 1, the accommodation body further includes a filter portion that is provided in the partial circulation flow passage, and includes a filter that filters the liquid.

10. A maintenance method of a liquid ejecting apparatus comprising the steps of:

providing the liquid ejecting apparatus having:

a liquid ejecting portion that ejects a liquid;

an installation portion designed to install an accommodation body accommodating the liquid;

a supply flow passage connecting the installation portion and the liquid ejecting portion for supplying the liquid toward the liquid ejecting portion;

a feedback flow passage connected to the supply flow passage on a side of the liquid ejecting portion from the installation portion, the feedback flow passage forming a circulation passage in cooperation with the supply flow passage and a partial circulation flow passage when the accommodation body is installed in the installation portion, the partial circulation flow passage being provided inside the accommodation body;

a flow mechanism that causes a fluid inside the circulation flow passage to flow; and driving the flow mechanism in a state in which the accommodation body is installed in the installation portion.

11. The maintenance method of a liquid ejecting apparatus according to claim 10, wherein the driving of the flow mechanism is performed and the fluid inside the circulation flow passage is flowed in a feedback direction in which the liquid flows from the liquid ejecting portion toward the installation portion in the feedback flow passage before the liquid is ejected from the liquid ejecting portion in a case in which the accommodation body is installed in the installation portion.

12. The maintenance method of a liquid ejecting apparatus according to claim 10, the accommodation body further includes a liquid accommodation portion that accommodates the liquid, wherein the driving of the flow mechanism is performed and the fluid inside the circulation flow passage is flowed in a feedback direction in which the liquid flows from the liquid ejecting portion toward the installation portion in the feedback flow passage in a case in which a liquid accommodation amount of the liquid accommodation portion is equal to or less than a stipulated value, which is smaller than an initial value of the liquid accommodation amount.

* * * * *